US007384542B1

(12) United States Patent
Thakkar et al.

(10) Patent No.: US 7,384,542 B1
(45) Date of Patent: Jun. 10, 2008

(54) PROCESS FOR THE PRODUCTION OF LOW SULFUR DIESEL AND HIGH OCTANE NAPHTHA

(75) Inventors: Vasant P. Thakkar, Elk Grove Village, IL (US); Richard K. Hoehn, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 282 days.

(21) Appl. No.: 10/862,731

(22) Filed: Jun. 7, 2004

(51) Int. Cl.
*C10G 45/00* (2006.01)
*C10G 47/00* (2006.01)
*C10G 53/06* (2006.01)

(52) U.S. Cl. ..... 208/213; 208/78; 208/80; 208/107; 208/108; 208/209

(58) Field of Classification Search ..... 208/213, 208/209, 107, 108, 78, 80
See application file for complete search history.

(56) References Cited

U.S. PATENT DOCUMENTS

| | | | | |
|---|---|---|---|---|
| 2,878,179 | A * | 3/1959 | Hennig | 208/57 |
| 4,846,959 | A * | 7/1989 | Kennedy et al. | 208/97 |
| 4,943,366 | A | 7/1990 | Fischer et al. | 208/68 |
| 5,958,218 | A * | 9/1999 | Hunter et al. | 208/78 |
| 6,328,880 | B1 * | 12/2001 | Yoshita et al. | 208/216 R |

* cited by examiner

*Primary Examiner*—Glenn Caldarola
*Assistant Examiner*—John C Douglas
(74) *Attorney, Agent, or Firm*—James C Paschall

(57) ABSTRACT

A process for the production of low sulfur diesel and high octane naphtha.

20 Claims, 1 Drawing Sheet

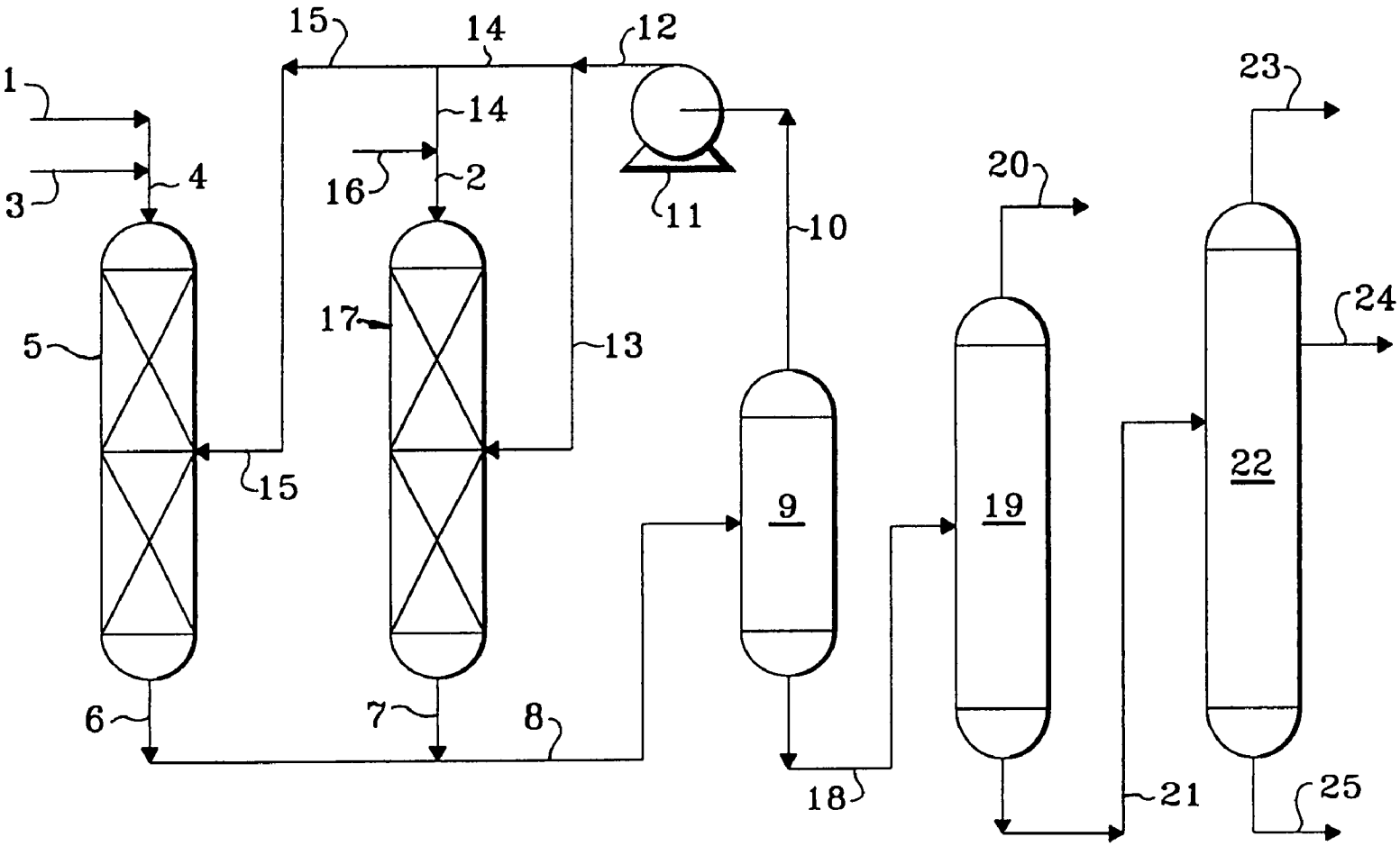
1
2
3
4
5
6
7
8
9
10
11
12
13
14
14
15
15
16
17
18
19
20
21
22
23
24
25

PROCESS FOR THE PRODUCTION OF LOW SULFUR DIESEL AND HIGH OCTANE NAPHTHA

BACKGROUND OF THE INVENTION

This invention relates to a process for the production of low sulfur diesel and high octane naphtha. More specifically, the invention is an integrated process for the hydrodesulfurization of middle distillate hydrocarbon streams and the hydrocracking of highly aromatic hydrocarbon streams.

Petroleum refiners produce desirable products such as turbine fuel, diesel fuel and middle distillates, as well as naphtha and gasoline, by hydrocracking a hydrocarbon feedstock derived from crude oil, for example. Feedstocks most often subjected to hydrocracking are gas oils and heavy gas oils recovered from crude oil by distillation. Refiners also subject middle distillate hydrocarbon streams to hydrodesulfurization. Although a wide variety of process flow schemes, operating conditions and catalysts have been used in commercial activities, there is always a demand for new hydroprocessing methods which provide lower costs, more valuable product yields and improved operability.

INFORMATION DISCLOSURE

U.S. Pat. No. 4,943,366 (Fischer et al.) discloses a hydrocracking process for converting highly aromatic, substantially dealkylated feedstock into high octane gasoline.

BRIEF SUMMARY OF THE INVENTION

The present invention is an integrated process for the production of low sulfur diesel and high octane naphtha. The process of the present invention utilizes a middle distillate hydrocarbon stream and a highly aromatic hydrocarbon stream. The middle distillate hydrocarbon feedstock is reacted with fresh make-up hydrogen in a hydrodesulfurization reaction zone and the highly aromatic hydrocarbon stream is reacted with recycle hydrogen in a hydrocracking zone. The resulting effluents from the two zones are introduced into a common high pressure vapor liquid separator to produce a hydrogen-rich recycle gas and a liquid stream containing desulfurized diesel and high octane naphtha which are then subsequently separated.

The use of make-up hydrogen as the source of hydrogen for the hydrodesulfurization reaction zone minimizes the recycle compressor duty and the use of the common separation and fractionation zones result in the advantages of lower capital and operating expenses.

Other embodiments of the present invention encompass further details such as detailed descriptions of feedstocks, hydrodesulfurization catalysts, hydrocracking catalysts, and preferred operating conditions, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

The present invention is an integrated process for the hydrodesulfurization of middle distillate hydrocarbon streams and the hydrocracking of highly aromatic hydrocarbon streams. Preferred feedstocks to the hydrodesulfurization reaction zone include distillate hydrocarbons boiling at a temperature greater than about 149° C. (300° F.) and more preferably boiling in the range from about 149° C. (300° F.) to about 399° C. (750° F.). Distillate hydrocarbon feedstocks are most often recovered from crude oil by distillation. However, distillate hydrocarbons may be utilized from any convenient source such as tar sand extract and gas to liquids for example. Furthermore, the distillate hydrocarbon feedstocks may contain from about 0.1 to about 4 weight percent sulfur.

The preferred highly aromatic hydrocarbon feedstocks boil in the range from about 149° C. (300° F.) to about 343° C. (650° F.). Highly aromatic, substantially dealkylated hydrocarbons are produced during the fluid catalytic cracking (FCC) of vacuum gas oils to produce high octane gasoline boiling range hydrocarbons. FCC is a thermally severe process which is operated without the presence of added hydrogen to reject carbon to coke and to produce residual fractions. During catalytic cracking, the high molecular weight feedstock disproportionates into relatively hydrogen-rich light liquids and aromatic, hydrogen-deficient heavier distillates and residues. The catalytic cracking in the absence of hydrogen does not provide significant desulfurization nor is the nitrogen content of the feed selectively rejected with the coke. The sulfur and nitrogen therefore concentrate in heavier cracking products and produces significant quantities of highly aromatic, hydrogen-deficient middle and heavy distillates with high sulfur and nitrogen levels. Recycling these liquids to the catalytic cracker is not an attractive option. A typical light cycle oil (LCO) from an FCC contains about 3 weight percent sulfur, about 700 wppm nitrogen and greater than about 80 volume percent aromatics. Present market requirements make refractory product streams such as light cycle oil particularly difficult to dispose of as commercially valuable products.

In one embodiment of the present invention, a highly aromatic, hydrogen deficient and substantially dealkylated hydrocarbon feedstock is introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). Its preferred to employ zeolites having a silica/alumina mole ratio between about 3 and 12. Suitable zeolites found in nature include, for example, mordenite, stillbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°-648° C. (700°-1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking reactor conditions which include a temperature from about 260° C. (500° F.) to about 426° C. (800° F.), a pressure from about 7.0 MPa (1000 psig) to about 10.5 MPa (1500 psig), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel.

The resulting effluent from the hydrocracking zone is preferably contacted with an aqueous stream to dissolve any ammonium salts and partially condensed, and then introduced into a high pressure vapor-liquid separator operated at a pressure substantially equal to the hydrocracking zone and a temperature in the range from about 38° C. (100° F.) to about 71° C. (160° F.). An aqueous stream is recovered from the vapor-liquid separator. A hydrogen-rich gaseous stream is removed from the vapor-liquid separator to provide at least a majority and preferably all of the hydrogen introduced into the hydrocracking zone.

In one embodiment of the present invention, a distillate hydrocarbon boiling at a temperature greater than about 149° C. (300° F.) is introduced into a desulfurization reaction zone together with a hydrogen-rich make-up stream at desulfurization reaction conditions. Preferred desulfurization reaction conditions include a temperature from about 260° C. (500° F.) to about 426° C. (800° F.), a pressure from about 7.0 MPa (1000 psig) to about 10.5 MPa (1500 psig), and a liquid hourly space velocity from about 0.1 hr−1 to about 10 $hr^{-1}$.

Suitable desulfurization catalysts for use in the present invention are any known convention desulfurization catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. Two or more catalyst beds and one or more quench points may be utilized in the reaction vessel or vessels. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the desulfurization reaction zone is contacted with an aqueous stream and partially condensed, and then introduced into the previously described high pressure vapor-liquid separator.

Fresh make-up hydrogen is directly introduced into the desulfurization reaction zone in order to supply high purity hydrogen to maximize the activity of the desulfurization catalyst. In a preferred embodiment, at least a majority of the hydrogen-rich recycle gas which is recovered in the high pressure vapor-liquid separator is recycled to the hydrocracking zone and more preferably essentially all of the hydrogen-rich recycle gas is recycled to the hydrocracking zone.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

Referring now to the drawing, a distillate hydrocarbon feedstock is introduced into the process via line 3 and is admixed with a fresh make-up hydrogen stream which is introduced via line 1. The resulting admixture is transported via line 4 and introduced into hydrodesulfurization reaction zone 5. A resulting effluent from hydrodesulfurization reaction zone 5 is carried via lines 6 and 8 and introduced into cold high pressure separator 9. A hydrogen-rich gaseous stream is removed from cold high pressure separator 9 via line 10 and introduced into compressor 11. A resulting compressed hydrogen-rich gaseous stream is transported via lines 12 and 14 and admixed with a light cycle oil feedstock provided via line 16 and the resulting admixture is transported via line 2 and introduced into hydrocracking zone 17. A resulting effluent from hydrocracking zone 17 is transported via line 7 and 8 and introduced into cold high pressure separator 9. Another hydrogen-rich gaseous stream is introduced via line 15 into hydrodesulfurization reaction zone 5. Yet another hydrogen-rich gaseous stream is introduced via line 13 into hydrocracking zone 17 to provide quench. A hydrocarbonaceous liquid stream is removed from cold high pressure separator 9 via line 18 and introduced into low pressure flash drum 19. A gaseous stream containing hydrogen and low boiling gaseous hydrocarbons are removed from low pressure flash drum 19 via line 20 and recovered. A liquid hydrocarbonaceous stream is removed from low pressure flash drum 19 via line 21 and introduced into fractionation zone 22. A normally gaseous hydrocarbonaceous stream is removed from fractionation zone 22 via line 23 and recovered. A high octane naphtha stream is removed from fractionation zone 22 via line 24 and recovered. The high octane naphtha stream may be recovered from fractionation zone 22 in any convenient manner and is preferably a sidecut as shown. A low sulfur diesel stream is removed from fractionation zone 22 via line 25 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A blend of straight run diesel and light coker gas oil (LCGO) in an amount of 4372 $m^3$/day (27,500 barrels per day) and having the characteristics presented in Table 1 is introduced along with a high purity make-up hydrogen stream into a hydrodesulfurization reaction zone operated at hydrodesulfurization reaction conditions summarized and presented in Table 2.

A stream of FCC light cycle oil (LCO) in an amount of 3657 $m^3$/day (23,000 barrels per day) and having the characteristics presented in Table 1 is introduced into a hydrocracking zone operated at hydrocracking conditions summarized and presented in Table 2.

The resulting effluent from the hydrodesulfurization reaction zone and the hydrocracking zone is cooled, partially condensed and introduced into a cold, high pressure vapor liquid separator operated at a pressure of about 9.7 MPa (1400 psig) and a temperature of about 43° C. (110° F.) to produce a hydrogen-rich recycle gas stream and a liquid hydrocarbonaceous stream. The hydrogen-rich recycle gas stream is recycled to the hydrocracking zone and the liquid hydrocarbonaceous stream is fractionated to produce a high octane naphtha stream (gasoline) boiling in the range of 88° C. (185° F.) to 193° C. (380° F.), in the amount of 2145 $m^3$/day (13,500 barrels per day) and having an octane number of 87, and a diesel stream boiling at a temperature greater than 193° C. (380° F.) in an amount of 5500 $m^3$/day (34,500 barrels per day) and having a sulfur content of <10 ppm and a cetane Index of 46.

TABLE 1

FEEDSTOCK ANALYSIS

| | Diesel/LCGO | Light Cycle Oil |
|---|---|---|
| Specific gravity | 0.87 | 0.96 |
| Total sulfur, weight percent | 2 | 1 |
| Total nitrogen, weight ppm | 725 | 900 |
| Distillation, ° C. (° F.) | | |
| IBP | 146 (295) | 215 (420) |
| 10% | 222 (432) | 263 (506) |
| 50% | 278 (543) | 304 (580) |
| 90% | 336 (638) | 349 (660) |
| EP | 390 (735) | 371 (700) |

TABLE 2

OPERATING CONDITIONS

| | Hydrodesulfurization | Hydrocracking |
|---|---|---|
| Pressure, MPa (psig) | 9.7 (1400) | 9.7 (1400) |
| Temperature, ° C. (° F.) | 371 (700) | 371 (700) |

The foregoing description, drawing and illustrative embodiment clearly illustrate the advantages encompassed by the process of the present invention and the benefits to be afforded with the use thereof.

What is claimed is:

1. An integrated process for the production of low sulfur diesel and high octane naphtha which process comprises:

a) reacting a distillate hydrocarbon feedstock having a boiling range greater than about 149° C. (300° F.) and a make-up hydrogen rich gaseous stream in a hydrodesulfurization reaction zone containing desulfurization catalyst to produce a hydrodesulfurization reaction zone effluent stream containing hydrocarbons having a reduced concentration of sulfur;

b) reacting a highly aromatic, substantially dealkylated hydrocarbon feedstock in a hydrocracking zone containing hydrocracking catalyst to produce a hydrocracking zone effluent stream comprising monocyclic aromatic compounds boiling in the naphtha range;

c) admixing the hydrodesulfurization zone effluent stream and the hydrocracking zone effluent stream to provide a resulting admixture stream; and d) separating the resulting admixture from step c) to produce a hydrogen-rich gaseous stream, a low sulfur diesel stream and a high octane naphtha stream.

2. The process of claim 1 wherein the resulting admixture stream of the hydrodesulfurization reaction zone effluent stream and hydrocracking zone effluent stream is introduced into a high pressure vapor-liquid separator to produce the hydrogen rich gaseous stream and an admixture comprising the liquid hydrocarbons from the hydrodesulfurization reaction zone effluent and hydrocracking zone effluent streams.

3. The process of claim 1 wherein a majority of the hydrogen rich gaseous stream from step d) is recycled to the hydrocracking zone, the hydrogen rich gaseous stream comprising hydrogen from both the hydrodesulfurization zone effluent stream and the hydrocracking zone effluent stream.

4. The process of claim 1 wherein the highly aromatic, substantially dealkylated hydrocarbon feedstock comprises hydrocarbons boiling in the range from about 149° C. (300° F.) to about 343° C. (650° F.).

5. The process of claim 1 wherein the distillate hydrocarbon feedstock boils in the range from about 149° C. (300° F.) to about 399° C. (750° F.), having reduced naphtha range hydrocarbons.

6. The process of claim 1 wherein the hydrodesulfurization reaction zone is operated at conditions including a pressure from about 7.0 MPa (1000 psig) to about 10.5 MPa (1500 psig) and a temperature from about 260° C. (500° F.) to about 426° C. (800° F.).

7. The process of claim 1 wherein the highly aromatic, substantially dealkylated hydrocarbon feedstock comprises light cycle oil.

8. The process of claim 1 wherein the hydrocracking zone is operated at conditions including a pressure from about 7.0 MPa (1000 psig) to about 10.5 MPa (1500 psig) and a temperature from about 260° C. (500° F.) to about 426° C. (800° F.).

9. The process of claim 1 wherein step (d) is performed in at least one fractionation zone where the high octane naphtha stream is separated from the hydrocarbonaceous content of the admixed hydrodesulfurization reaction zone effluent stream and hydrocracking zone effluent stream.

10. The process of claim 1 wherein essentially all of the hydrogen-rich gaseous stream from step (d) is recycled to the hydrocracking zone.

11. An integrated process for the production of low sulfur diesel and high octane naphtha which process comprises:

a) reacting a distillate hydrocarbon feedstock boiling in the range from about 149° C. (300° F.) to about 399° C. (750° F.) and a make-up hydrogen rich gaseous stream in a hydrodesulfurization reactor containing desulfurization catalyst to produce a hydrodesulfurization reactor effluent stream containing hydrocarbons having a reduced concentration of sulfur;

b) reacting a highly aromatic, substantially dealkylated hydrocarbon feedstock comprising light cycle oil in a hydrocracking reactor comprising hydrocracking catalyst to produce a hydrocracking reactor effluent stream comprising monocyclic aromatic compounds boiling in the naphtha range;

c) introducing the hydrodesulfurization reactor effluent stream and the hydrocracking reactor effluent stream into a common high pressure vapor-liquid separator to produce a hydrogen-rich gaseous stream containing hydrogen from both the hydrodesulfurization zone effluent stream and the hydrocracking zone effluent stream and a liquid hydrocarbonaceous stream;

d) separating the liquid hydrocarbonaceous stream recovered in step (c) to produce at least a first stream containing low sulfur diesel and a second stream containing high octane naphtha;

e) recycling at least a majority of the hydrogen-rich gaseous stream to the hydrocracking zone; and wherein the hydrodesulfurization reactor and the hydrocracking reactor are separate reactors operating in parallel and concurrently.

12. The process of claim 11 wherein the hydrodesulfurization reaction zone is operated at conditions including a pressure from about 7.0 MPa (1000 psig) to about 10.5 MPa (1500 psig) and a temperature from about 260° C. (500° F.) to about 426° C. (800° F.).

13. The process of claim 11 wherein the hydrocracking zone is operated at conditions including a pressure from about 7.0 MPa (1000 psig) to about 10.5 MPa (1500 psig) and a temperature from about 260° C. (500° F.) to about 426° C. (800° F.).

14. The process of claim 11 wherein step (d) is performed in at least one fractionation zone.

15. The process of claim 11 wherein essentially all of the hydrogen-rich gaseous stream from step (c) is recycled to the hydrocracking zone.

16. An integrated process for the production of low sulfur diesel and high octane naphtha which process comprises:

a) reacting a distillate hydrocarbon feedstock boiling in the range from about 149° C. (300° F.) to about 399° C. (750° F.) and a make-up hydrogen rich gaseous steam in a hydrodesulfurization reaction zone containing desulfurization catalyst operated at conditions including a pressure from about 7.0 MPa (1000 psig) to about 10.5 MPa (1500 psig) and a temperature from about 260° C. (500° F.) to about 426° C. (800° F.) to produce a hydrodesulfurization reaction zone effluent stream containing hydrocarbons having a reduced concentration of sulfur;

b) simultaneously and in parallel with the hydrodesulfurization reaction zone, reacting a highly aromatic, substantially dealkylated hydrocarbon feedstock comprising light cycle oil in a hydrocracking zone containing hydrocracking catalyst operated at conditions including a pressure from about 7.0 MPa (1000 psig) to about 10.5 MPa (1500 psig) and a temperature from about 260° C. (500° F.) to about 426° C. (800° F.) to produce a hydrocracking zone effluent stream comprising monocyclic aromatic compounds boiling in the naphtha range;

c) introducing the hydrodesulfurization reaction zone effluent stream and the hydrocracking zone effluent stream into a high pressure vapor liquid separator to produce a hydrogen-rich gaseous stream and an admixed liquid hydrocarbonaceous stream comprising the hydrocarbons having a reduced concentration of sulfur from the hydrodesulfurization reaction zone effluent stream and the monocyclic aromatic compounds from the hydrocracking zone effluent stream;

d) separating the admixed liquid hydrocarbonaceous stream recovered in step (c) to produce at least a first stream containing low sulfur diesel and a second stream containing high octane naphtha; and e) recycling at least a majority of the hydrogen-rich gaseous stream to the hydrocracking zone.

17. The process of claim 16 wherein step (d) is performed in at least one fractionation zone.

18. The process of claim 16 wherein essentially all of the hydrogen-rich gaseous stream from step (c) is recycled to the hydrocracking zone.

19. The process of claim 5 wherein the high octane naphtha stream of step d) comprises high octane naphtha provided from the hydrodesulfurization zone effluent stream and high octane naphtha provided from the hydrocracking zone effluent stream.

20. The process of claim 1 wherein the initial boiling point range of the distillate hydrocarbon feedstock is no lower than about the heaviest boiling point of the high octane naphtha stream.

* * * * *